US007170472B2

(12) United States Patent
Park et al.

(10) Patent No.: US 7,170,472 B2
(45) Date of Patent: Jan. 30, 2007

(54) APPARATUS AND METHOD FOR DRIVING PLASMA DISPLAY PANEL

(75) Inventors: Chung Hoo Park, Pusan-shi (KR); Dong Hyun Kim, Pusan-shi (KR); Sung Hyun Lee, Pusan-shi (KR); Young Kee Kim, Pusan-shi (KR); Jeong Eun Heo, Kimhae-shi (KR); Joong Hong Shin, Pusan-shi (KR); Ho Jun Lee, Pusan-shi (KR); Eung Kwan Lee, Daegu-shi (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 10/224,592

(22) Filed: Aug. 21, 2002

(65) Prior Publication Data

US 2003/0098822 A1 May 29, 2003

(30) Foreign Application Priority Data

Nov. 24, 2001 (KR) ..... 10-2001-73639

(51) Int. Cl.
*G09G 3/28* (2006.01)

(52) U.S. Cl. ..... 345/68; 345/63; 345/66; 315/169.1; 315/169.3

(58) Field of Classification Search ..... 345/37, 345/41, 42, 60–72, 208, 211–214, 690; 315/169.1–169.3
See application file for complete search history.

(56) References Cited

U.S. PATENT DOCUMENTS

| | | | | |
|---|---|---|---|---|
| 5,745,085 | A * | 4/1998 | Tomio et al. | 345/63 |
| 5,745,086 | A * | 4/1998 | Weber | 345/63 |
| 6,249,087 | B1 * | 6/2001 | Takayama et al. | 315/169.1 |
| 6,492,776 | B2 * | 12/2002 | Rutherford | 315/169.1 |
| 6,803,888 | B1 * | 10/2004 | Nakamura et al. | 345/60 |
| 6,822,644 | B1 * | 11/2004 | Awamoto et al. | 345/211 |
| 6,836,262 | B2 * | 12/2004 | Hashimoto et al. | 345/60 |
| 6,937,213 | B2 * | 8/2005 | Iwasa et al. | 345/60 |
| 2001/0040536 | A1 | 11/2001 | Tajima et al. | 345/55 |
| 2002/0054001 | A1 * | 5/2002 | Awamoto | 345/60 |

FOREIGN PATENT DOCUMENTS

| | | |
|---|---|---|
| JP | 06-314078 | 11/1994 |
| TW | 419614 | 9/1999 |

* cited by examiner

*Primary Examiner*—Henry N. Tran
(74) *Attorney, Agent, or Firm*—Fleshner & Kim, LLP

(57) ABSTRACT

An apparatus and method for driving a plasma display panel wherein an initializing discharge can be weakened to lower a dark room brightness and an initialization time can be shortened to permit a single scanning. In the apparatus, a sensing device senses an electrical signal with an initialization waveform applied from a voltage source to a display panel. A controlling device controls said electrical signal with an initialization waveform applied from the voltage source to the display panel by the sensed electrical signal.

48 Claims, 18 Drawing Sheets

(a) EQUIVALENT CIRCUIT (b)VCR (c)CCR (a)VCR (b)CCR (a)VCR (b)CCR

APPARATUS AND METHOD FOR DRIVING PLASMA DISPLAY PANEL

BACKGROUND OF THE INVENTION

1. Field of the Invention

This invention relates to a technique of driving a plasma display panel, and more particularly to an apparatus and method for driving a plasma display panel wherein an initializing discharge can be weakened to lower a dark room brightness and an initialization time can be shortened to permit a single scanning.

2. Description of the Related Art

Generally, a plasma display panel (PDP) radiates light from phosphors excited an ultraviolet generated during a gas discharge, thereby displaying a picture including characters and graphics. Such a PDP is easy to be made into a slim and large-dimension type. Moreover, the PDP provides a very improved picture quality owing to a recent technical development.

Referring to FIG. 1, a conventional three-electrode, AC surface-discharge PDP includes a scan electrode Y and a sustain electrode Z provided on an upper substrate 10, and an address electrode X provided on a lower substrate 18.

The scan electrode Y and the sustain electrode Z have transparent electrodes 12Y and 12Z, and metal bus electrodes 13Y and 13Z having a smaller line width than the transparent electrodes 12Y and 12Z and formed on one edges of the transparent electrodes 12Y and 12Z, respectively. The transparent electrodes 12Y and 12Z are formed from a transparent conductive metal, such as indium-tin-oxide (ITO), on the upper substrate 10. The metal bus electrodes 13Y and 13Z is formed from a metal such as chrome (Cr), etc. on the transparent electrodes 12Y and 12Z, respectively, and play a role to reduce a voltage drop caused by a high resistance of the transparent electrodes 12Y and 12Z.

An upper dielectric layer 14 and a protective film 16 are disposed on the upper substrate 10 on which the scan electrode Y and the sustain electrode Z are provided in parallel to each other. Wall charges generated upon plasma discharge are accumulated in the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

The address electrode X is crossed to the scan electrode Y and the sustain electrode Z. A lower dielectric layer 20 and barrier ribs 22 are formed on the lower substrate 18 provided with the address electrode X. The barrier ribs 22 are provided in parallel to the address electrode X and prevent an ultraviolet ray and a visible light produced during a discharge from being leaked into adjacent discharge cells. The surfaces of the lower dielectric layer 20 and the barrier ribs 22 are coated with a phosphor layer 24. The phosphor layer 24 is excited by an ultraviolet ray generated upon plasma display to produce any one of red, green and blue visible lights. An inactive mixture gas of He+Xe or Ne+Xe is injected into a discharge space defined between the upper and lower substrate 10 and 18 and the barrier rib 22.

The PDP cell having the structure as described above maintains a discharge by a surface discharge between the scan electrode Y and the sustain electrode Z after it was selected by an opposite discharge between the address electrode X and the scan electrode Y. In the PDP cell, a phosphor 24 is radiated by an ultraviolet ray generated upon sustain discharge to emit a visible light into the exterior of the cell. As a result, the PDP having the cells display a picture. In this case, the PDP controls a discharge sustain period of the cell, that is, the number of sustain discharge in accordance with a video data to thereby realize a gray scale required for an image display.

In order to express gray levels of a picture, such a PDP is driven by an address and display period-separated (ADS) system in which one frame is divided into various subfields having the number of different discharge for its driving.

Each sub-field is divided into an initialization period, a write period and a sustain period. For instance, when it is intended to display a picture of 256 gray levels, a frame interval equal to 1/60 second (i.e. 16.67 ms) is divided into 8 sub-fields. Each of the 8 sub-fields is again divided into a write period and a sustain period. Herein, the initialization period and the write period of each sub-field are equal every sub-field, whereas the sustain period is increased at a ratio of $2^n$ (wherein n=0, 1, 2, 3, 4, 5, 6 and 7) at each sub-field. As described above, the sustain period becomes different at each sub-field, so that it is possible to express gray levels of a picture.

Referring to FIG. 2, a driving waveform is largely divided into four periods, that is, a reset period for equalizing an initial condition of the panel into a predetermined state, a write period for selecting a discharge cell, a sustain period for expressing a gray scale depending upon the number of discharge and an erase period for erasing a discharge.

In the initialization period, the address electrode X and the sustain electrode Z remain at 0V during a first-half initializing operation. At this time, the scan electrode Y is coupled with a rising ramp voltage ramp1 having a slow slope from a sustain voltage Vs less than a discharge initiating voltage until a setup voltage Vr going beyond the discharge initiating voltage with respect to the sustain electrode Z. When the rising ramp voltage ramp1 is being increased, the discharge cell generates a weak initialization discharge between the sustain electrode Z and the scan electrode Y. Accordingly, a negative (−) wall voltage is accumulated in the surface of the protective film 16 provided on the scan electrode Y while a positive (+) wall voltage is accumulated in the surface of the lower dielectric layer 20 provided on the address electrode X and the surface of the protective film 16 provided on the sustain electrode Z.

During the following second-half initializing operation, a positive (+) voltage Vz is applied to all the sustain electrodes Z. Further, all the scan electrodes Y is coupled with a falling ramp voltage ramp2 having a slow slope from a sustain voltage Vs less than a discharge initiation voltage until 0V with respect to the sustain electrode Z. When the falling ramp voltage ramp2 is being decreased, all the discharge cells again generate an erase discharge between the sustain electrode Z and the scan electrode Y. Accordingly, the negative (−) wall voltage accumulated in the surface of the protective film 16 provided on the scan electrode Y and the positive (+) wall voltage accumulated in the surface of the protective film 16 provided on the sustain electrode Z are weakened. Further, a weak discharge is generated between the address electrode X and the scan electrode Y, and the positive (+) wall voltage on the surface of the lower dielectric layer 20 provided on the address electrode X is controlled into a proper condition for a write discharge in the write period.

In the write period, firstly, the scan electrode Y remains at a predetermined positive (+) voltage. Subsequently, a predetermined positive (+) write pulse Vx is applied to the address electrode X corresponding to the discharge cell to be selected, and a scan pulse Vy falling into 0V is applied to the scan electrode Y in such a manner to be synchronized with the write pulse Vx. Accordingly, at an intersection between the address electrode X and the scan electrode Y, a voltage between the surface of the lower dielectric layer 20 and the surface of the protective film 16 provided on the scan electrode Y has a value obtained by adding the positive(+) wall voltage on the surface of the lower dielectric layer 20 provided on the address electrode X to the write pulse Vx.

For this reason, at an intersection between the address electrode X and the scan electrode Y, a write discharge is generated between the address electrode X and the scan electrode Y and between the sustain electrode Z and the scan electrode Y. Accordingly, a positive (+) wall voltage is accumulated in the surface of the protective film 16 provided on the scan electrode Y at an intersection between the address electrode X and the scan electrode Y while a negative (−) wall charge is accumulated in the surface of the protective film 16 provided on the sustain electrode Z.

In the sustain period, firstly, levels of the scan electrode Y and the sustain electrode Z remain at 0V. Thereafter, a positive (+) sustain pulse Vs us is alternately applied to the scan electrode Y and the sustain electrode Z. Accordingly, at the discharge cell causing a write discharge, a voltage between the surface of the protective film 16 on the scan electrode Y and the surface of the protective film 16 on the sustain electrode Z is added by the positive (+) wall voltage accumulated in the surface of the protective film 16 on the scan electrode Y and the negative (−) wall voltage accumulated in the surface of the protective film 16 on the sustain electrode Z to go beyond a discharge initiation voltage. Therefore, the discharge cell selected by the write discharge generates a sustain discharge by a sustain pulse Vs us applied alternately.

The following erase period, the sustain electrode Z is coupled with a positive (+) erase ramp waveform Ve rising from 0V at a slow slope. At this time, at the discharge cell generating a sustain discharge, the positive (+) voltages accumulated in the surface of the protective film 16 on the scan electrode Y and the surface of the protective film 16 on the sustain electrode Z are added to the erase ramp waveform Ve. Thus, the discharge cell generating a sustain discharge causes a weak erase discharge between the sustain electrode Z and the scan electrode Y. Accordingly, the negative (−) wall voltage accumulated in the surface of the protective film 16 on the scan electrode Y and the positive (+) wall voltage accumulated in the surface of the protective film 16 on the sustain electrode Z is weakened to stop a sustain discharge.

In such an AC surface-discharge type PDP driving method, a ramp waveform is applied from a voltage controlled ramp (VCR) supply as shown in FIG. 3 in the initialization period.

Referring to FIG. 3, the VCR supply includes a rising ramp waveform supply 30 and a falling ramp waveform supply 32 connected, in parallel, to the panel, that is, the scan electrode Y. The rising ramp waveform supply 30 produces a rising ramp waveform rising from a sustain voltage Vs until a setup voltage Vr at a predetermined slope, and includes a first switch Q1 for supplying a rising ramp waveform in response to a control signal, and a first control signal generating device CS1 provided between the gate terminal and the source terminal of the first switch Q1. Further, a first capacitor C1 provided between the gate terminal and the drain terminal of the first switch Q1 is connected, in parallel, to a first resistor R1 provided between the gate terminal thereof and the first control signal generating device CS1. A common voltage source VDD is connected to the drain terminal of the first switch Q1. The first control signal generating device CS1 plays a role to apply a control signal to the gate terminal of the first switch Q1 to switch the first switch Q1.

The first capacitor C1 and the first resistor R1 set a voltage flowing, via the first switch Q1, into the panel by a RC time constant value. In other words, by this RC time constant value, a rising ramp waveform applied to the panel rises at a predetermined slope. Thus, a voltage from the common voltage source VDD rises at a predetermined slope from a sustain voltage Vs until a setup voltage Vr of 400V like the reset waveform shown in FIG. 2. Thereafter, when it falls from the setup voltage Vr of about 400V into the sustain voltage Vs of about 180V, a reverse voltage of about −70V is generated between the gate terminal and the source terminal of the first switch Q1 to damage the first switch Q1. In order to prevent this, a first diode D1 connected, in parallel, to the first resistor R1 is provided. Accordingly, a rising ramp waveform having a constant slop during a RC charge and discharge time caused by the first resistor R1 and the first capacitor C1 is applied to the panel.

The falling ramp waveform supply 32 generates a falling ramp waveform falling from the sustain voltage Vs into a ground level GND at a predetermined slope, and includes a second switch Q2 for switching the falling ramp waveform into the display panel in response to a control signal, and a second control signal generating device CS2 provided between the gate terminal and the source terminal of the second switch Q2. Further, a second capacitor C1 provided between the gate terminal and the drain terminal of the second switch Q2 is connected, in parallel, to a second resistor R2 provided between the gate terminal thereof and the second control signal generating device CS2. The drain terminal of the second switch Q2 is connected to the panel while the source terminal thereof is connected to the ground voltage source. The second control signal generating device CS2 plays a role to apply a control signal to the gate terminal of the second switch Q2 to switch the second switch Q2.

The second capacitor C2 and the second resistor R2 set a voltage flowing, via the second switch Q2, into the panel by a RC time constant value. In other words, by this RC time constant value, a falling ramp waveform applied to the panel falls at a predetermined slope. Thus, a falling ramp waveform falls at a predetermined slope from the sustain voltage Vs until the ground level GND like the reset waveform shown in FIG. 2. Thereafter, when it falls from about 180V into the ground level GND, a reverse voltage of about −70V is generated between the gate terminal and the source terminal of the second switch Q2 to damage the second switch Q2. In order to prevent this, a second diode D2 connected, in parallel, to the second resistor R2 is provided. Accordingly, a voltage applied to the panel is decreased at a constant slope with the lapse of a RC charge and discharge time from a variable resistance of the second switch Q2 and the second capacitor C2 between the drain terminal and the gate terminal thereof.

Such a system employing the voltage controlled rising and falling ramp waveforms from the VCR supply slowly increase and thereafter decrease a ramp voltage at a long ramp time to generate a weak discharge repetitively, so that it can form wall voltages and space charges in a discharge space to lower a write voltage. Also, it has an advantage in that it reduces a background light at an initialization time to improve a dark room contrast ratio.

However, when a ramp time is lengthened, an initialization time also is increased. As a result, a sustain period is reduced and hence a brightness is reduced. If a ramp time is shortened to reduce an initialization time, then a discharge current is increased to generate an oscillation at a lamp waveform due to a gap voltage between a voltage and a wall voltage applied at an opposite polarity within the discharge cell. Thus, the background light is increased by the discharge to cause an unstable discharge state, thereby raising a write failure.

Therefore, there has been required a novel driving scheme capable of restraining an oscillation of the gap voltage by controlling a discharge current depending upon a load in the discharge cell as well as reducing an initialization time without any increase of the ground light, instead of the VCR system of applying a voltage waveform given independently of a load variation in the discharge cell.

SUMMARY OF THE INVENTION

Accordingly, it is an object of the present invention to provide a plasma display panel driving apparatus and method wherein an initializing discharge can be weakened to lower a dark room brightness and an initialization time can be shortened to permit a single scanning.

In order to achieve these and other objects of the invention, a driving apparatus for a plasma display panel according to one aspect of the present invention includes a sensor for sensing an electrical signal with an initialization waveform applied from a voltage source to a display panel; and a controlling device for controlling said electrical signal with an initialization waveform applied from the voltage source to the display panel by the sensed electrical signal.

In the driving apparatus, the controlling device is a switching device arranged between the voltage source and the display panel.

The electrical signal is any one of a current and a voltage.

The voltage source is selected from any one of a setup voltage source and a set-down voltage source.

The sensing device is a resistor device provided between the controlling device and the display panel.

The resistor device adjusts a rising slope of said initialization waveform applied to the display panel.

The resistor device adjusts a falling slope of said initialization waveform applied to the display panel.

The driving apparatus further includes a diode provided between the voltage source and the display panel.

The controlling device further includes a control signal generating device provided between a control terminal of the switching device and the display panel to control the switching device.

A driving apparatus for a plasma display panel according to another aspect of the present invention includes a setup voltage source; a set-down voltage source; a first sensing device for sensing an electrical signal with a first initialization waveform applied from the setup voltage source to a display panel; a first controlling device for controlling said electrical signal with said first initialization waveform applied from the setup voltage source to the display panel by the sensed electrical signal; a second sensing device for sensing an electrical signal with a second initialization waveform applied from the set-down voltage source to a display panel; and a second controlling device for controlling said electrical signal with said second initialization waveform applied from the set-down voltage source to the display panel by the sensed electrical signal.

In the driving apparatus, the first controlling device is a first switching device arranged between the setup voltage source and the display panel.

The second controlling device is a second switching device arranged between the set-down voltage source and the display panel.

The electrical signal is any one of a current and a voltage.

The first sensing device is a first resistor device provided between the first controlling device and the display panel.

The first resistor device adjusts a rising slope of said first initialization waveform applied to the display panel.

The second sensing device is a second resistor device provided between the second controlling device and the set-down voltage source.

The second resistor device adjusts a falling slope of said second initialization waveform applied to the display panel.

The driving apparatus further includes a first diode provided between the setup voltage source and the display panel.

The driving apparatus further includes a second diode provided between the set-down voltage source and the display panel.

The first controlling device further includes a first control signal generating device provided between a control terminal of the first switching device and the display panel.

The second controlling device further includes a second control signal generating device provided between a control terminal of the second switching device and the display panel.

A method of driving a plasma display panel according to still another aspect of the present invention includes the steps of sensing an electrical signal with an initialization waveform applied from a voltage source to a display panel; and controlling said electrical signal with an initialization waveform applied from the voltage source to the display panel by the sensed electrical signal.

In the method, said electrical signal is any one of a current and a voltage.

The voltage source is selected from any one of a setup voltage source and a set-down voltage source.

The step of controlling said electrical signal with said initialization waveform includes adjusting any one of rising and falling slopes of said initialization waveform applied to the display panel.

A method of driving a plasma display panel according to still another aspect of the present invention includes the steps of sensing an electrical signal with a first initialization waveform applied from a setup voltage source to a display panel; controlling said electrical signal with said first initialization waveform applied from the setup voltage source to the display panel by the sensed electrical signal; sensing an electrical signal with a second initialization waveform applied from a set-down voltage source to a display panel; and controlling said electrical signal with said second initialization waveform applied from the set-down voltage source to the display panel by the sensed electrical signal.

In the method, said electrical signals with said first and second initialization waveforms are any one of a current and a voltage.

The step of controlling said electrical signal with said first initialization waveform includes adjusting a rising slope of said first initialization waveform applied to the display panel.

The step of controlling said electrical signal with said second initialization waveform includes adjusting a falling slope of said second initialization waveform applied to the display panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
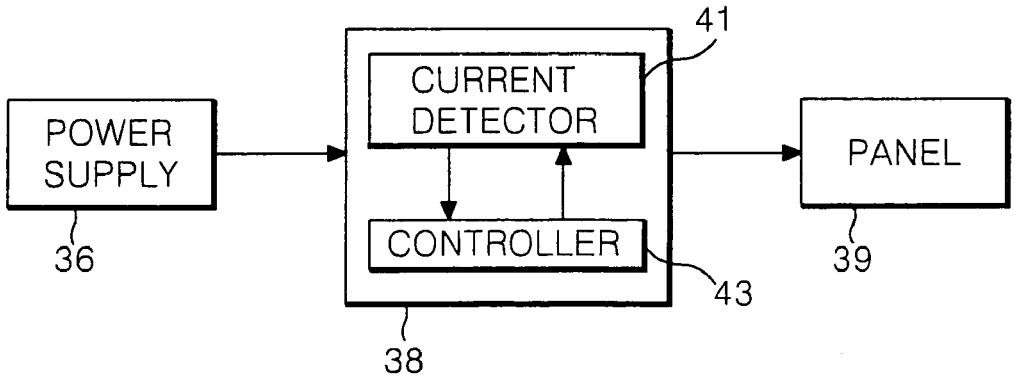
FIG. 4 is a block diagram showing a configuration of a PDP driving apparatus according to an embodiment of the present invention.

Referring to FIG. 4, a plasma display panel (PDP) driving apparatus according to an embodiment of the present invention includes a power supply 36, and a ramp waveform generating device 38 for controlling a discharge current applied from the power supply 36 to a panel 39 to generate a ramp waveform. The ramp waveform generating device 38 includes a current sensing device 41 for sensing a current applied from the power supply 36, and a controlling device 43 for controlling the discharge current applied from the power supply 36 to the panel 39 depending upon the sensed current.

Figure 5:
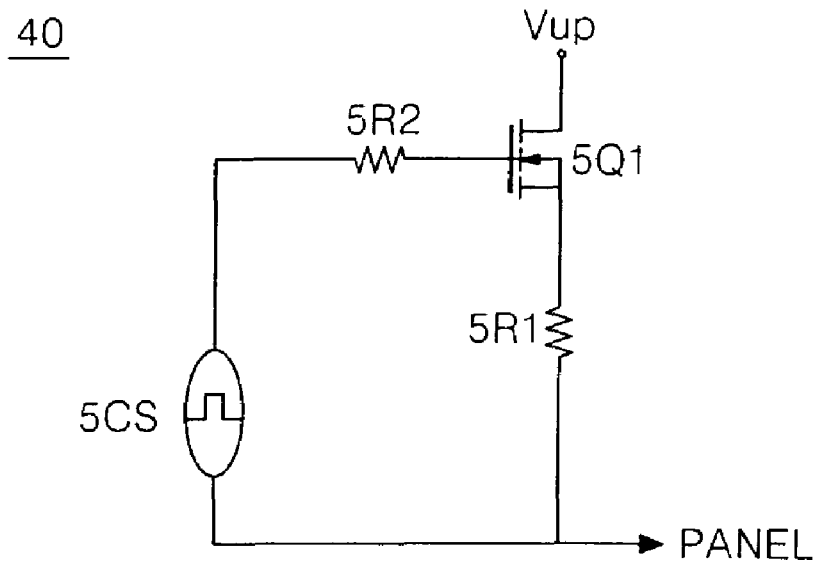
FIG. 5 is a circuit diagram of a rising initialization waveform generating device for generating a rising initialization waveform according to a first embodiment of the present invention.
Figure 6:
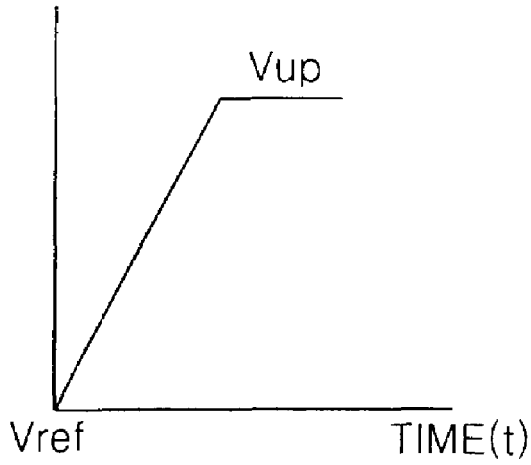
FIG. 6 illustrates an output waveform of the rising initialization waveform driving apparatus shown in FIG. 5.

Referring to FIG. 5 and FIG. 6, a rising initialization waveform supply 40 in a plasma display panel according to a first embodiment of the present invention supplies the panel 39 with a rising initialization waveform rising from a sustain voltage Vref until a setup voltage Vup at a predetermined slope, and includes a switch 5Q1 for switching a voltage supplied from a setup voltage source Vup into the panel 39 in response to a control signal, a first resistor 5R1 provided between the source terminal of the switch 5Q1 and the panel 39, and a control signal generating device 5CS provided between the gate terminal of the switch 5Q1 and the panel 39 to apply a control signal to the gate terminal thereof.

The switch 5Q1 has a drain terminal connected to the setup voltage source Vup, a gate terminal supplied with a setup control signal and a source terminal connected to the panel 39. Herein, the switch 5Q1 is generally made of a field effect transistor (FET). The control signal generating device 5CS plays a role to apply a control signal to the gate terminal of the switch 5Q1 to switch it. To this end, a second resistor 5R2 is provided between the gate terminal of the switch 5Q1 and the control signal generating device 5CS. The first resistor 5R1 senses a current flowing, via the switch 5Q1, into the panel 39 by a resistance value to control the switch 5Q1. A current applied to the panel 39 is controlled by a resistance value of the first resistor 5R1, thereby causing a rising initialization waveform voltage to have a predetermined rising slope. Herein, the first resistor 5R1 may be a variable resistor.

More specifically, when a voltage of 3V to 4V is applied from the control signal generating device 5CS, the switch 5Q1 is turned on to thereby apply a direct current voltage from the setup voltage source Vup to the panel. Thus, a panel discharge is generated at the panel and a discharge current flows in the panel due to this panel discharge, thereby causing a voltage drop across the first resistor 5R1. Accordingly, a relative voltage drop occurs between the gate terminal and the source terminal of the switch 5Q1 to turn off the switch 5Q1. As a result, a rising initialization waveform rising from a sustain voltage Vref until a setup voltage Vup at a predetermined slope is applied to the panel. Meanwhile, a diode connected between the setup voltage source Vup and the panel to break a current supplied directly from the setup voltage source Vup to the panel may be further provided.

Figure 7:
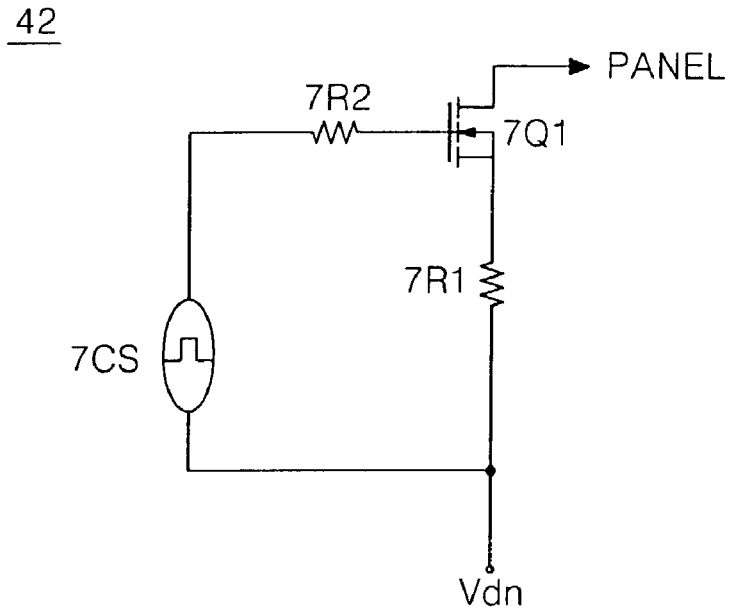
FIG. 7 is a circuit diagram of a falling initialization waveform generating device for generating a falling initialization waveform according to a second embodiment of the present invention.
Figure 8:
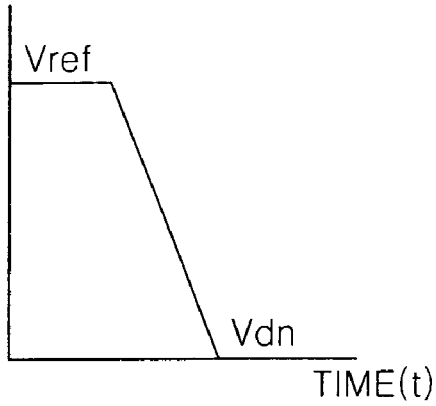
FIG. 8 illustrates an output waveform of the falling initialization waveform driving apparatus shown in FIG. 5.

Referring to FIG. 7 and FIG. 8, a falling initialization waveform supply 42 in a plasma display panel according to a second embodiment of the present invention supplies the panel with a falling initialization waveform falling from a sustain voltage Vref until a set-down voltage Vdn at a predetermined slope, and includes a switch 7Q1 for switching a voltage supplied to the panel into a set-down voltage source Vdn in response to a control signal, a first resistor 7R1 provided between the switch 7Q1 and the set-down voltage source Vdn, and a control signal generating device 7CS provided between the gate terminal of the switch 7Q1 and the set-down voltage source Vdn to apply a control signal to the gate terminal of the switch 7Q1.

The switch 7Q1 has a drain terminal connected to the panel, a gate terminal supplied with a setup control signal and a source terminal connected to the set-down voltage source Vdn. Herein, the switch 7Q1 is generally made of a field effect transistor (FET). The control signal generating device 7CS plays a role to apply a control signal to the gate terminal of the switch 7Q1 to switch it. To this end, a second resistor 7R2 is provided between the gate terminal of the switch 7Q1 and the control signal generating device 7CS. The first resistor 7R1 senses a current flowing, via the switch 7Q1, into the panel by its resistance value to control the switch 7Q1. A current applied to the panel is controlled by a resistance value of the first resistor 7R1, thereby causing a falling initialization waveform voltage to have a predetermined falling slope. Herein, the first resistor 7R1 may be a variable resistor.

More specifically, when a voltage of 3 to 4V is applied from the control signal generating device 7CS, the switch 7Q1 is turned on, thereby allowing a current from the panel to flow into the set-down voltage source Vdn. Thus, a panel discharge is generated at the panel and a discharge current flows in the panel due to this panel discharge, thereby causing a voltage drop across the first resistor 7R1. Accordingly, a relative voltage drop occurs between the gate terminal and the source terminal of the switch 7Q1 to turn off the switch 7Q1. As a result, a falling initialization waveform falling from a sustain voltage Vref until a set-down voltage Vdn at a predetermined slope is applied to the panel. Meanwhile, a diode connected between the set-down voltage source Vdn and the panel to break a backward current supplied from the panel may be further provided.

Figure 9:
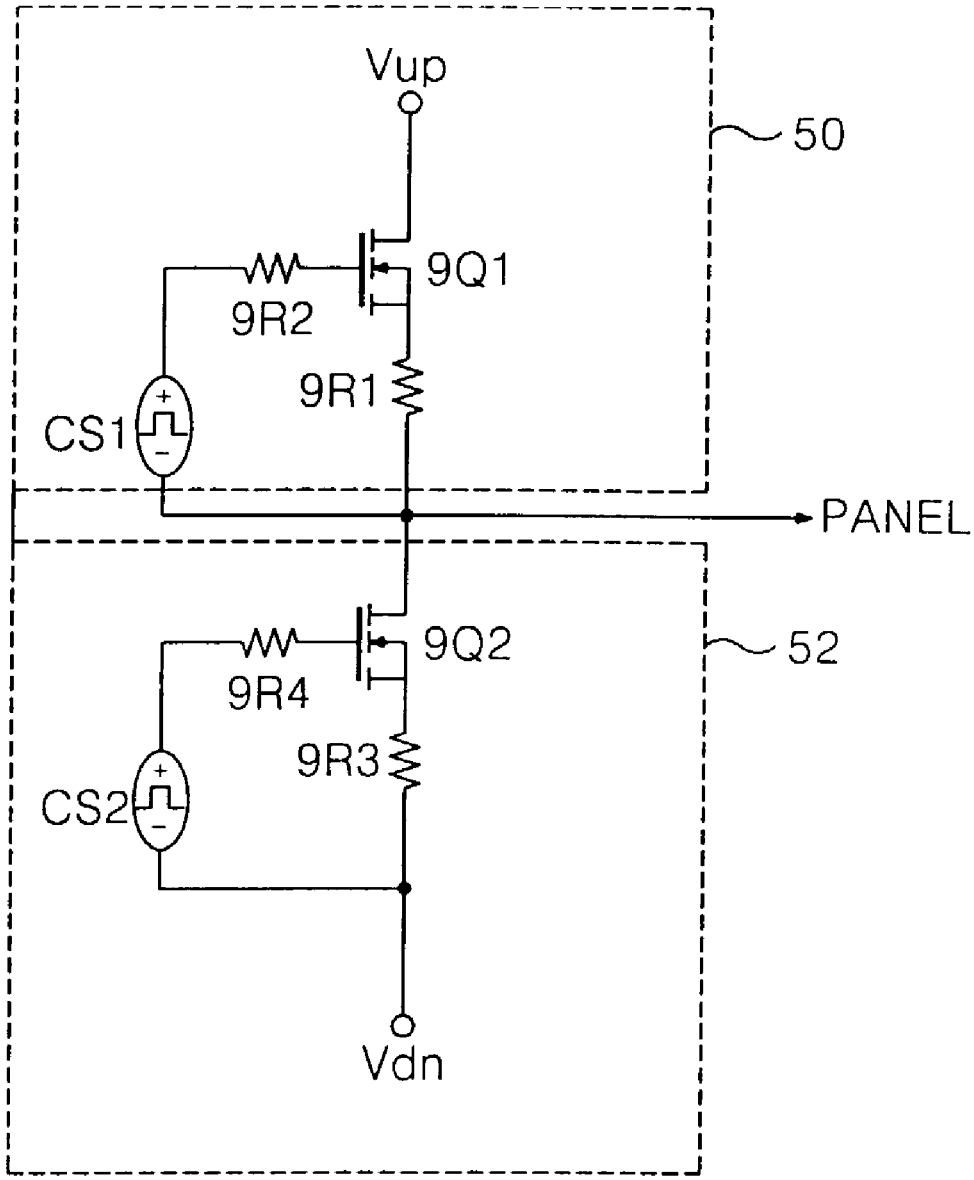
FIG. 9 is a circuit diagram of a PDP driving apparatus according to a third embodiment of the present invention.

Referring to FIG. 9, a plasma display panel (PDP) driving apparatus according to a third embodiment of the present invention includes a rising initialization waveform supply 50 for supplying the panel with a rising initialization waveform at the initialization period, and a falling initialization waveform supply 52 for supplying the panel with a falling initialization waveform after supplying the rising initialization waveform.

The rising initialization waveform supply 50 includes a first switch 9Q1 for switching a voltage supplied from a setup voltage source Vup into the panel in response to a control signal, a first resistor 9R1 provided between the source terminal of the first switch 9Q1 and the panel, and a first control signal generating device CS1 provided between the gate terminal of the first switch 9Q1 and the panel to apply a control signal to the gate terminal thereof.

The first switch 9Q1 has a drain terminal connected to the setup voltage source Vup, a gate terminal supplied with a setup control signal and a source terminal connected to the panel. Herein, the first switch 9Q1 is generally made of a field effect transistor (FET). The first control signal generating device CS1 plays a role to apply a control signal to the gate terminal of the first switch 9Q1 to switch it. To this end, a second resistor 9R2 is provided between the gate terminal of the first switch 9Q1 and the first control signal generating device CS1. The first resistor 9R1 senses a current flowing, via the switch 9Q1, into the panel by its resistance value to control the switch 9Q1. A current applied to the panel is controlled by a resistance value of the first resistor 9R1, thereby causing a rising initialization waveform voltage to have a predetermined rising slope. Herein, the first resistor 9R1 may be a variable resistor. Meanwhile, a diode connected between the setup voltage source Vup and the panel to break a current supplied directly from the setup voltage source Vup to the panel may be further provided.

The failing initialization waveform supply 52 includes a second switch 9Q2 for switching a voltage supplied to the panel into a set-down voltage source Vdn in response to a control signal, a third resistor 9R3 provided between the second switch 9Q2 and the set-down voltage source Vdn, and a second control signal generating device CS2 provided between the gate terminal of the second switch 9Q2 and the set-down voltage source Vdn to apply a control signal to the gate terminal of the second switch 9Q2.

The second switch 9Q2 has a drain terminal connected to the panel, a gate terminal supplied with a setup control signal and a source terminal connected to the set-down voltage source Vdn. Herein, the second switch 9Q2 is generally made of a field effect transistor (FET). The second control signal generating device CS2 plays a role to apply a control signal to the gate terminal of the second switch 9Q2 to switch it. To this end, a fourth resistor 9R4 is provided between the gate terminal of the second switch 9Q2 and the second control signal generating device CS2. The third resistor 9R3 senses a current flowing, via the second switch 9Q2, into the panel by its resistance value to control the second switch 9Q2. A current applied to the panel is controlled by a resistance value of the third resistor 9R3, thereby causing a falling initialization waveform voltage to have a predetermined falling slope. Herein, the third resistor R3 may be a variable resistor. Meanwhile, a diode connected between the set-down voltage source Vdn and the panel to break a backward current supplied from the panel may be further provided.

In such a PDP driving apparatus according to the third embodiment of the present invention, when a voltage of 3V to 4V is applied from the first control signal generating device CS1, the first switch 9Q1 is turned on to thereby apply a direct current voltage from the setup voltage source Vup to the panel. Thus, a panel discharge is generated at the panel and a discharge current flows in the panel due to this panel discharge, thereby causing a voltage drop across the first resistor 9R1. Accordingly, a relative voltage drop occurs between the gate terminal and the source terminal of the first switch 9Q1 to turn off the first switch 9Q1. As a result, a rising initialization waveform rising from a sustain voltage Vref until a setup voltage Vup at a predetermined slope is applied to the panel.

After the rising initialization waveform applied to the panel as described above, when a voltage of 3V to 4V is applied from the second control signal generating device CS2, the second switch 9Q2 is turned on, thereby allowing a current from the panel to flow into the set-down voltage source Vdn. Thus, a panel discharge is generated at the panel and a discharge current flows in the panel due to this panel discharge, thereby causing a voltage drop across the third resistor 9R3. Accordingly, a relative voltage drop occurs between the gate terminal and the source terminal of the second switch 9Q2 to turn off the second switch 9Q2. As a result, a falling initialization waveform falling from a sustain voltage Vref until a set-down voltage Vdn at a predetermined slope is applied to the panel.

As described above, the present PDP driving apparatus, hereinafter referred to as "CCR supply", controls a voltage supplied from the setup voltage source Vup via the first and second switches 9Q1 and 9Q2 switched alternately by a control signal and controls a current applied to the panel with the aid of the first and third resistors 9R1 and 9R3, thereby applying a rising or falling initialization waveform to the scan lines of the panel. Accordingly, the CCR supply according to the present invention controls a current applied to the panel to restrain an oscillation of a gap voltage, and reduces an initialization time while reducing a background light to enhance a contrast ratio.

Figure 10:
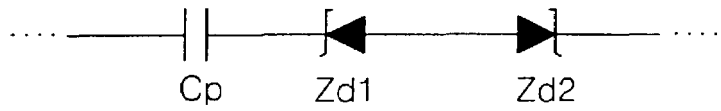
FIG. 10 is an equivalent circuit diagram of a discharge cell and a waveform diagram for comparing a voltage controlled initialization waveform with a current controlled initialization waveform applied to the discharge cell.
Figure 10:
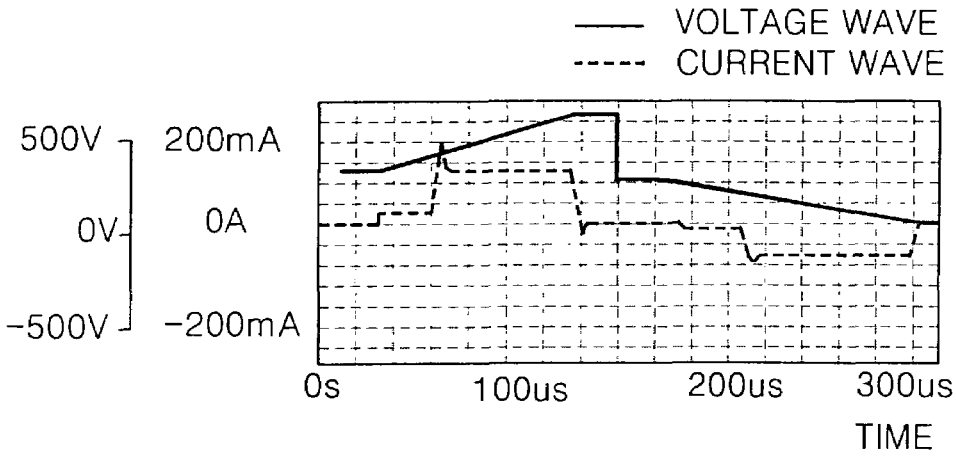
Figure 10:
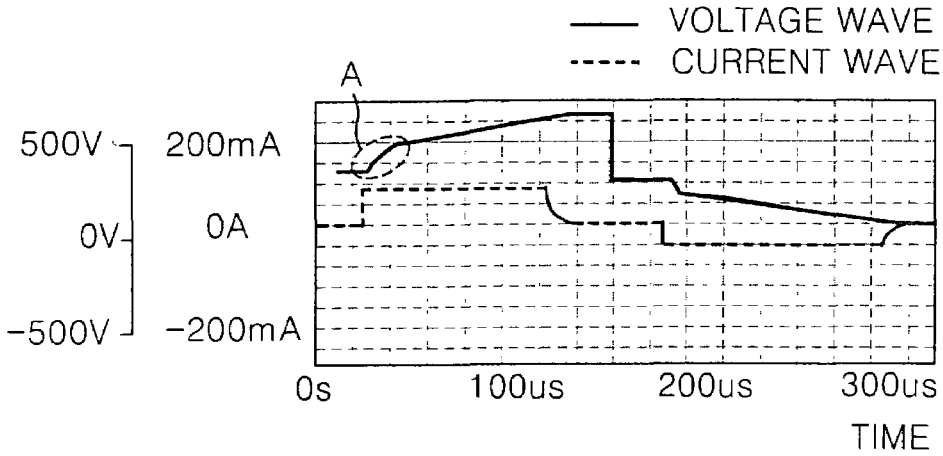

FIG. 10A is an equivalent circuit diagram of a typical discharge cell. Referring to FIG. 10A, the discharge cell consists of a capacitor Cp and two Zener diodes Zd1 and Zd2. Herein, it is assumed that the two Zener diodes generate a Zener breakdown at 210V.

VCR and CCR waveforms in FIG. 10B and FIG. 10C are supplied with the same sustain voltage Vref and setup voltage Vup.

As for the VCR of FIG. 10B, an initialization waveform is a waveform generated from a charge and discharge caused by a PC irrespectively of a load variation of the discharge cell. On the other hand, as for the CCR of FIG. 10C, it can be seen that a voltage waveform A at a region where a discharge is generated should be changed. This results from an applied current being controlled by the first resistor 9R1 or 5R1.

Figure 11A:
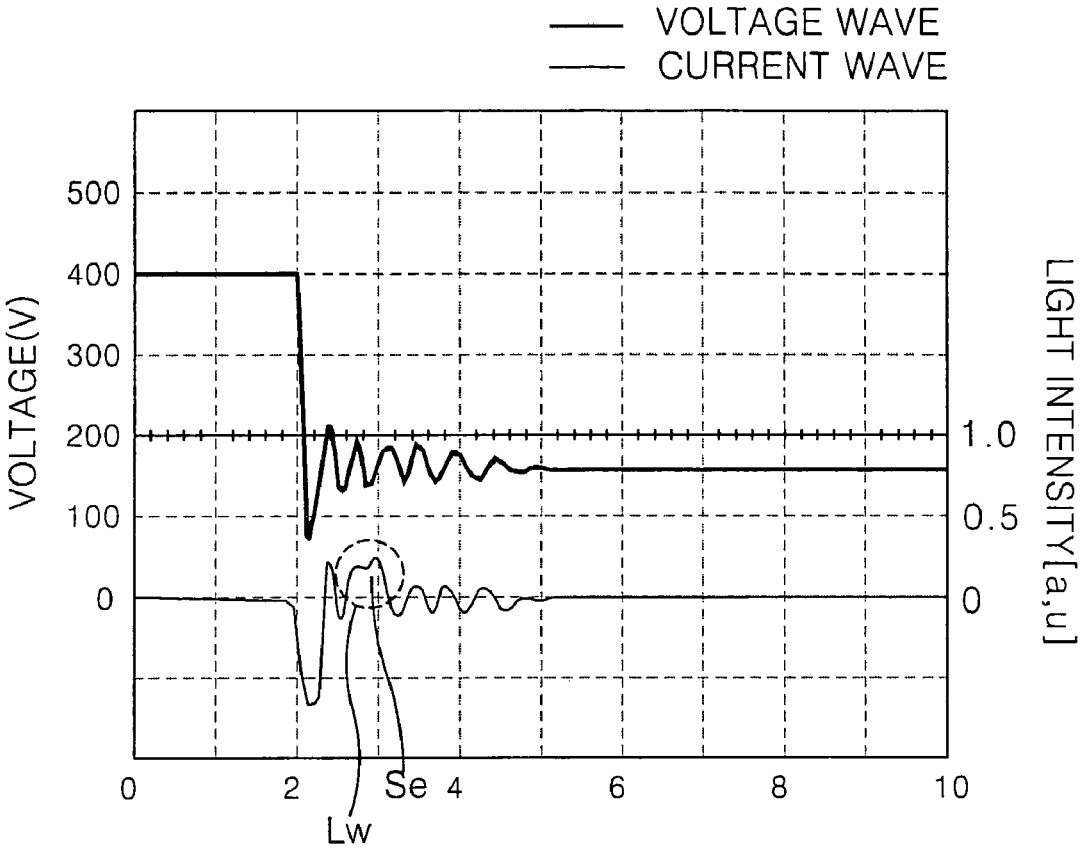
FIG.11(a) PRIOR ART
FIG. 11 is a waveform diagram showing VCR and CCR voltage waveforms and light waveforms when a rising initialization waveform falls from a setup voltage into a sustain voltage after it was applied to the discharge cell.
Figure 11B:
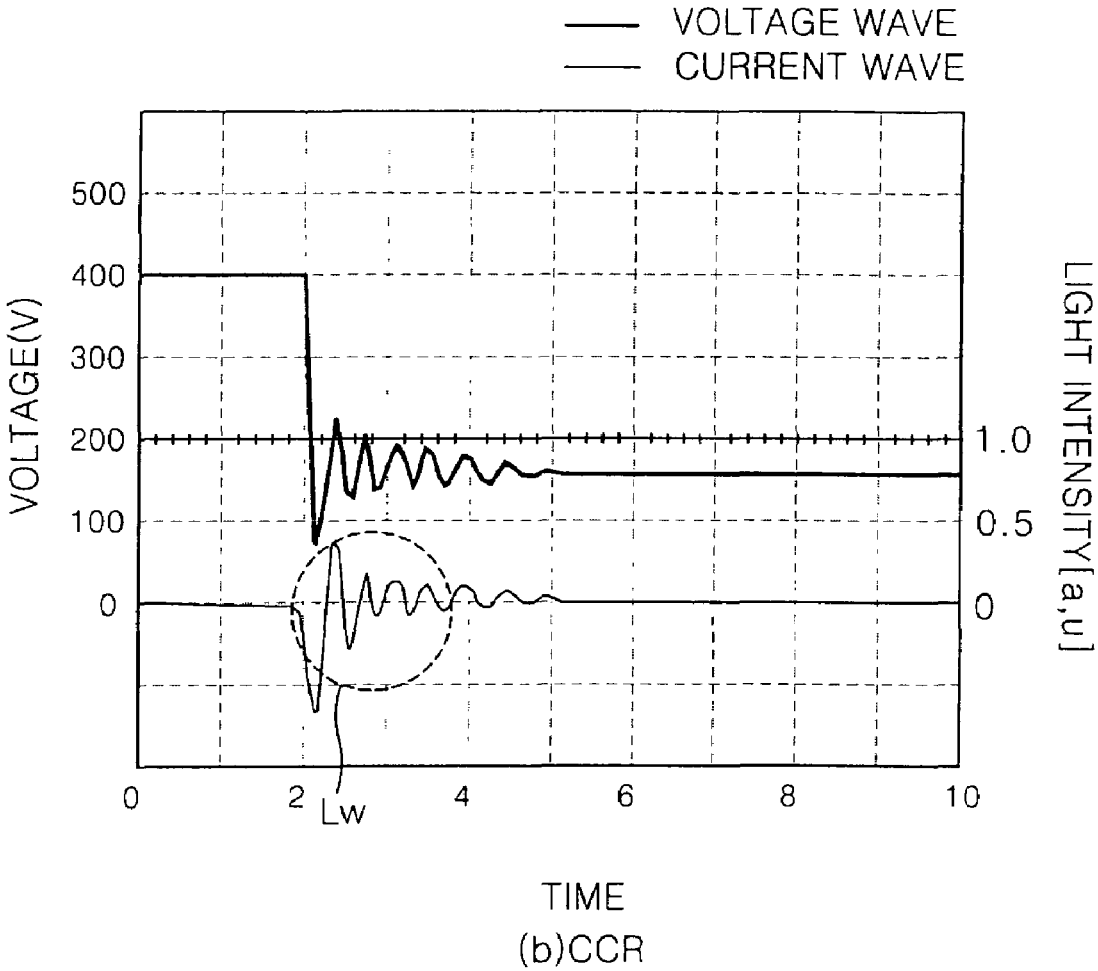

FIG. 11A and FIG. 11B illustrate voltage waveforms and light waveforms of the VCR and the CCR, respectively, when a rising initialization waveform rises from a setup voltage Vup into a sustain voltage vref after its application. Herein, the light waveform means a waveform of a light generated by a discharge current.

Figure 1:
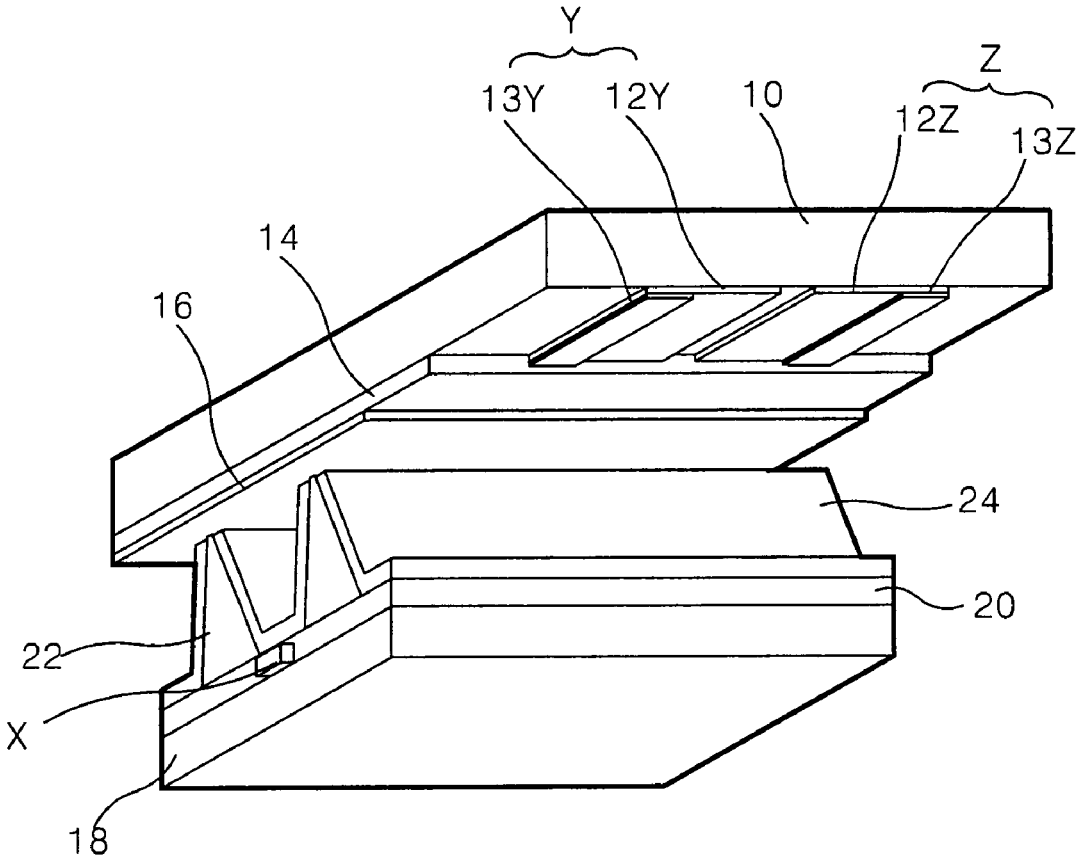
FIG. 1 PRIOR ART
FIG. 1 is a perspective view showing a structure of a discharge cell of a general AC surface-discharge type plasma display panel.
Figure 2:
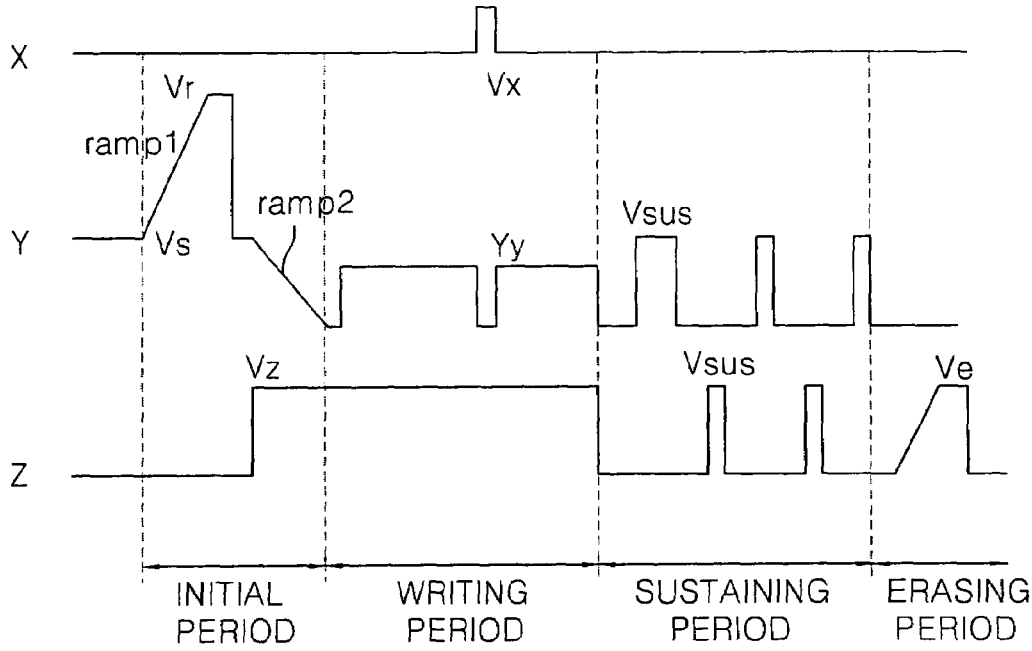
FIG. 2 PRIOR ART
FIG. 2 illustrates a driving waveform for driving the discharge cell of the PDP shown in FIG. 1.
Figure 3:
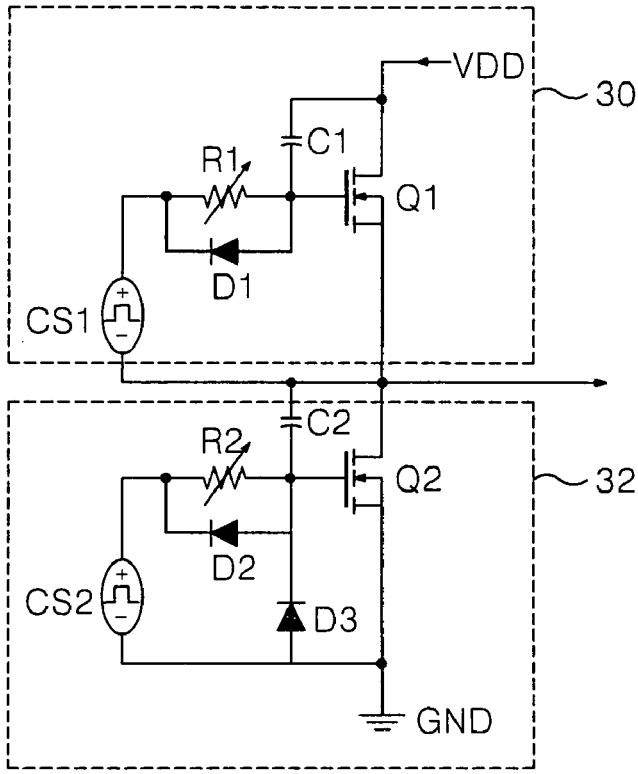
FIG.3 PRIOR ART
FIG. 3 is a circuit diagram of a voltage controlled ramp waveform supply for supplying a ramp waveform in the initialization period shown in FIG. 2.

In FIG. 11A, when the conventional VCR voltage waveform falls from the setup voltage Vup until the sustain voltage Vref, a damping phenomenon automatically appears as a light waveform Lw by a noise resulting from a switching operation of the first switch Q1 shown in FIG. 3. This light waveform Lw is added to a current component resulting from a self-erasure discharge Se to cause a misfiring as shown in FIG. 12A.

Figure 12A:
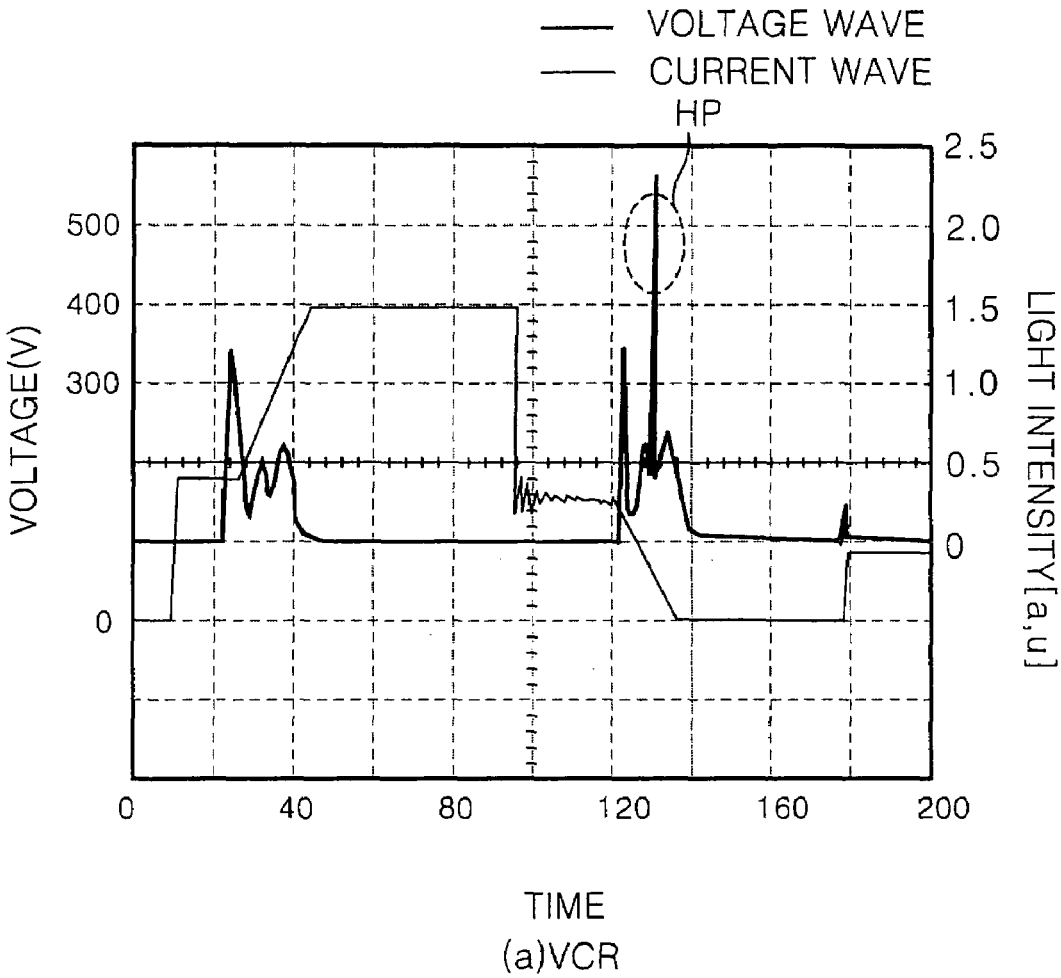
FIG.12(a) PRIOR ART
FIG. 12 is a waveform diagram representing whether or not there is any erroneous discharge in the conventional VCR and the present CCR.

It is can be seen from FIG. 12A that an unstable high peak voltage HP is continuously sensed from the light waveform due to a damping phenomenon resulting from the switching noise and a misfiring resulting from the self-erasure discharge Se. This is caused by a fact that when rising and falling initialization waveforms are applied during 20 μs so as to shorten an initialization time, a discharge current within the discharge cell is suddenly increased upon application of the rising initialization waveform to generate an excessive discharge and increase a wall charge. Accordingly, after the rising initialization waveform was applied, the self-erasure discharge Se is generated to cause a write failure.

Figure 12B:
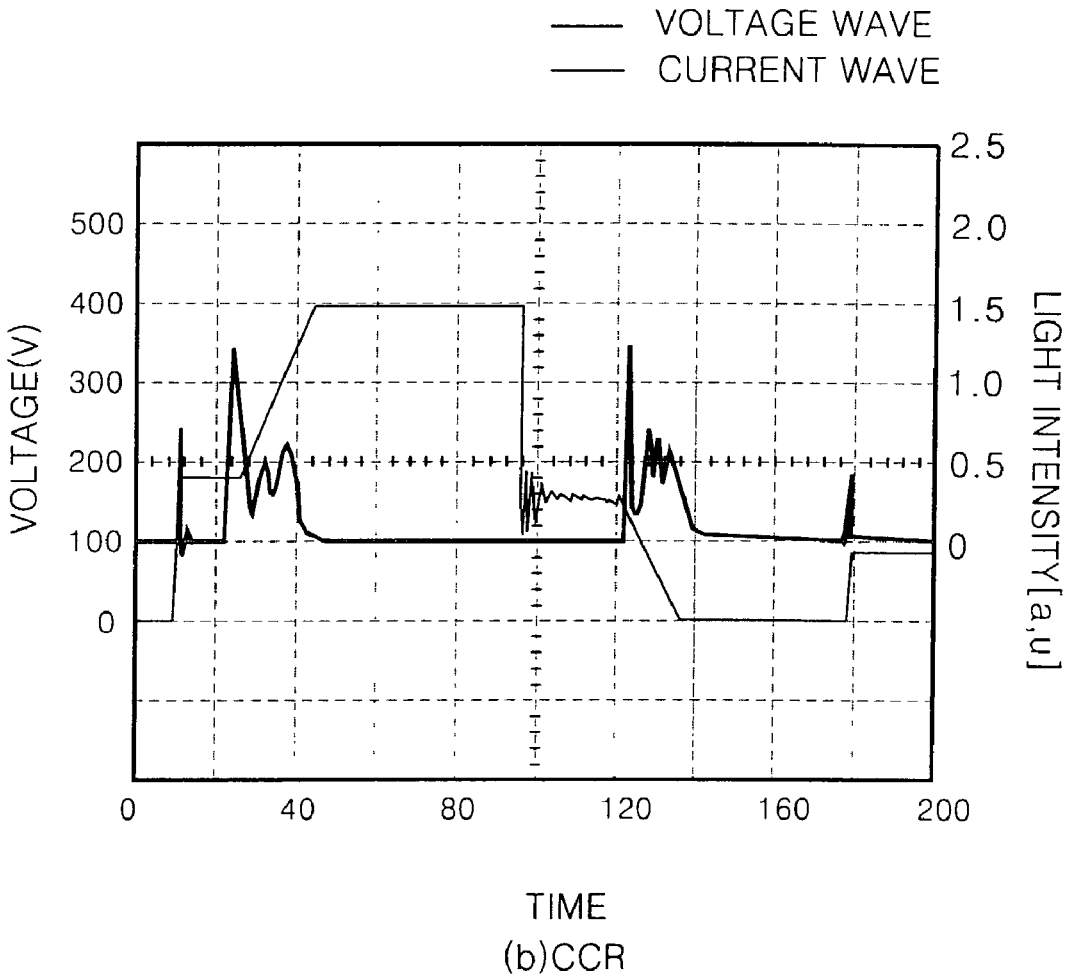

On the other hand, in FIG. 12B, when an initialization waveform of the CCR according to the present invention falls from the setup voltage Vup until the sustain voltage Vref, a damping phenomenon automatically appears only as a light waveform Lw by a noise resulting from a switching operation of the first switch 5Q1 or 9Q1 shown in FIG. 5 or FIG. 9, thereby preventing a generation of misfiring. This limits an addition of a current component caused by a self-erasure discharge Se to the light waveform Lw like the conventional VCR because the present CCR supply is a system of controlling an applied current, so that a stable light waveform as shown in FIG. 12B emerges and hence a write failure does not occur.

Hereinafter, the present CCR will be compared with the conventional VCR with reference to experimental data in FIG. 13A to FIG. 15B.

FIG. 13A to FIG. 13D compares variations in background light brightness (VCR: "□", CCR: "○") and full-white brightness (VCR: "□8, CCR:") in the sustain period according to an application time (i.e., 20 μs, 50 μs, 100 μs and 150 μs) of a falling initialization waveform when an application time of a rising initialization waveform is 20 μs, 50 μs, 100 μs and 150 μs, respectively.

Figure 13A:
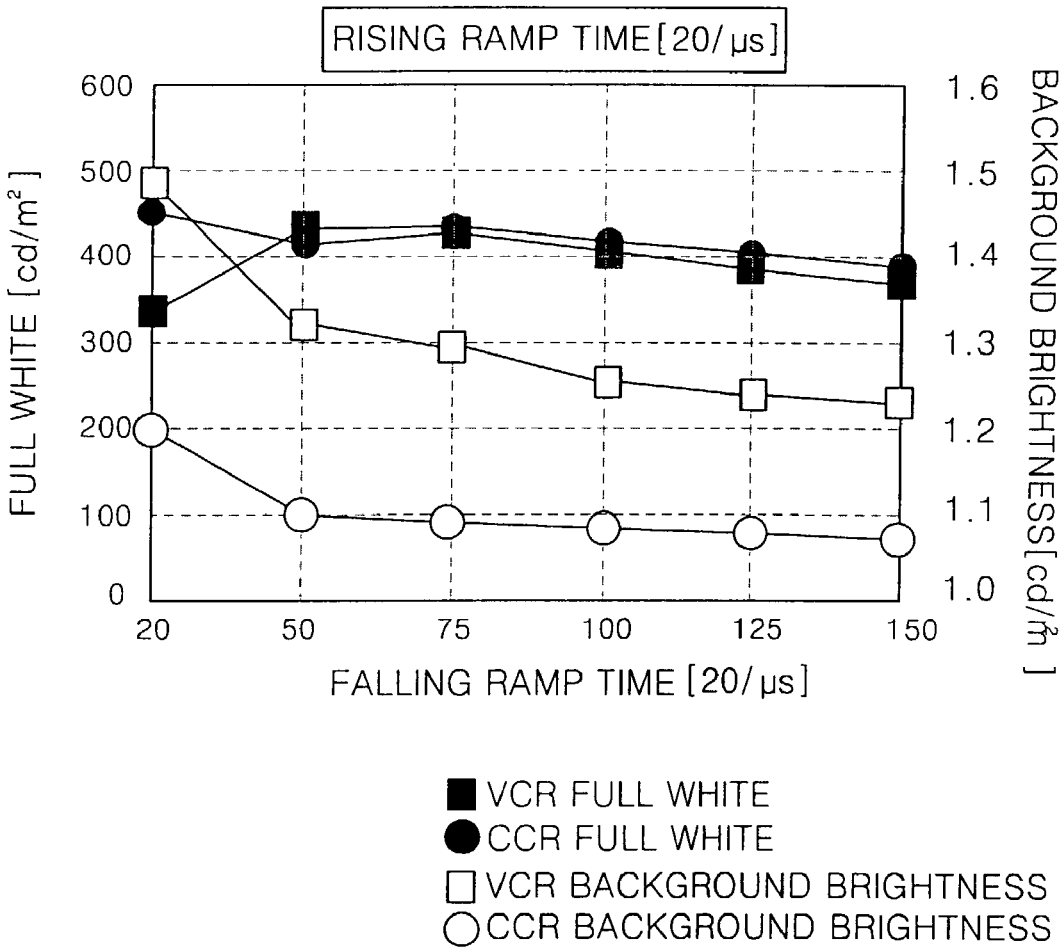
FIG. 13A to FIG. 13D are graphs for comparing a background light brightness and a full-white brightness in the sustain period according to a ramp waveform supply time in the conventional VCR with those in the present CCR.

In FIG. 13A, when an application time of a rising initialization waveform is 20 μs, a background light brightness of the CCR according to the present invention appears lower than that of the conventional VCR as an application time of a rising initialization waveform goes shorter. Also, a full-white brightness in the sustain period of the present CCR appears higher than that of the conventional VCR when an application time of a falling initialization waveform is 20 μs, and appears more similarly to the conventional VCR as it is gradually increased into 20 μs, 100 μs and 150 μs.

Figure 13B:
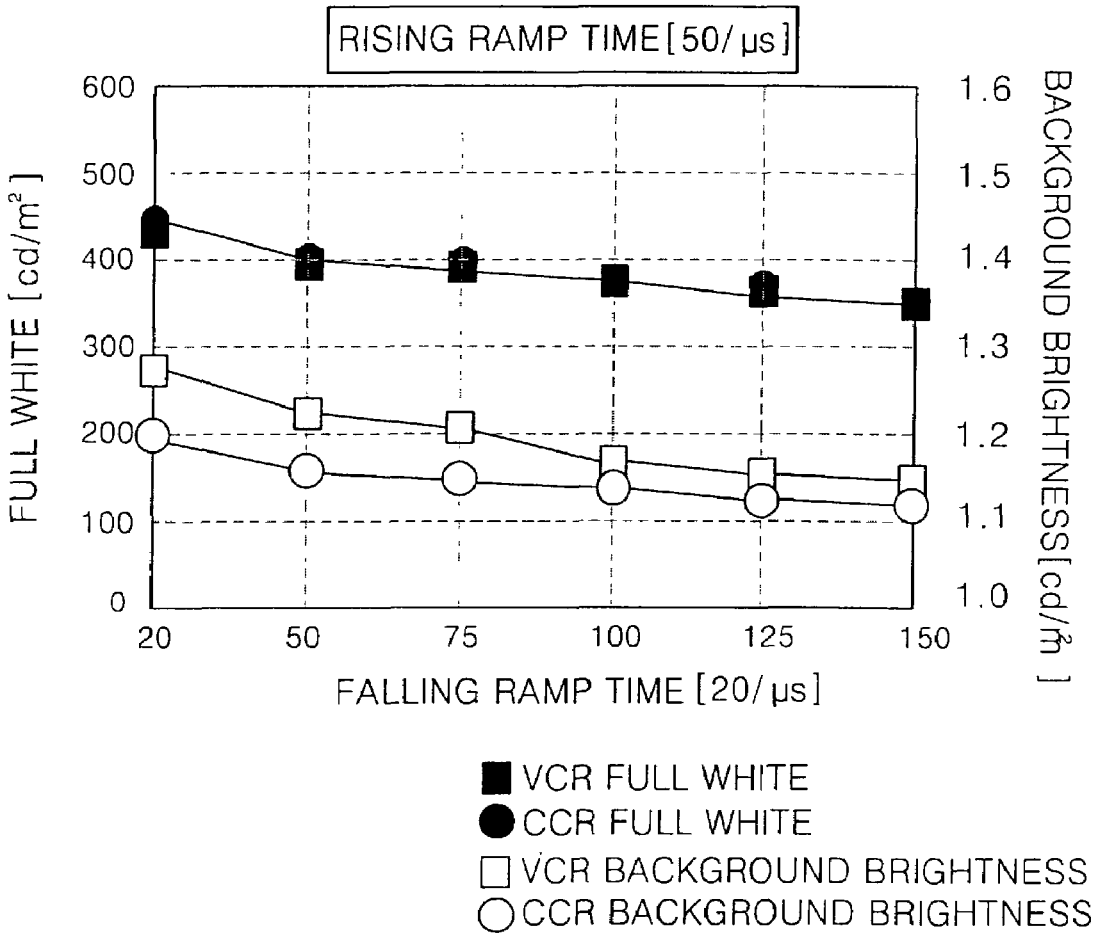

In FIG. 13B, when an application time of a rising initialization waveform is 20 μs, a background light brightness of the CCR according to the present invention appears lower than that of the conventional VCR with respect to all the application times (i.e., 20 μs, 50 μs, 100 μs and 150 μs) of a falling initialization waveform. On the other hand, a full-white brightness in the sustain period of the present CCR appears slightly higher than that of the conventional VCR with respect to all the application times.

Figure 13C:
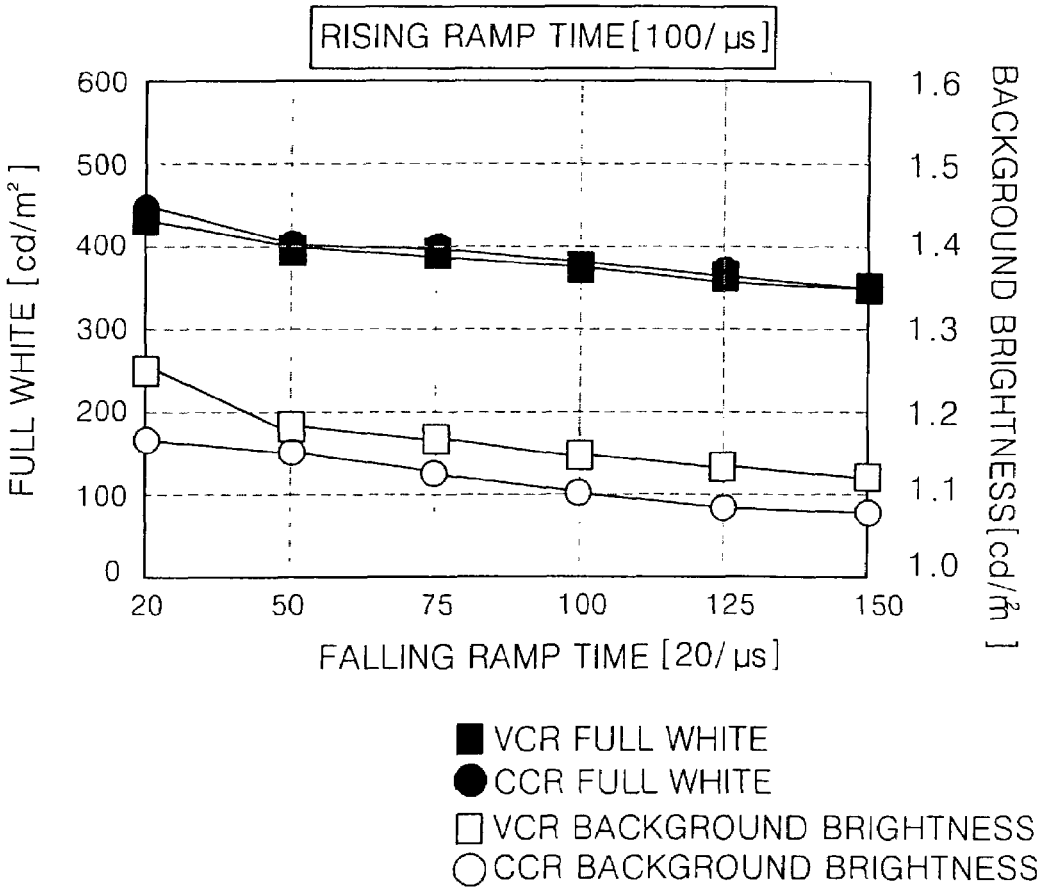
Figure 13D:
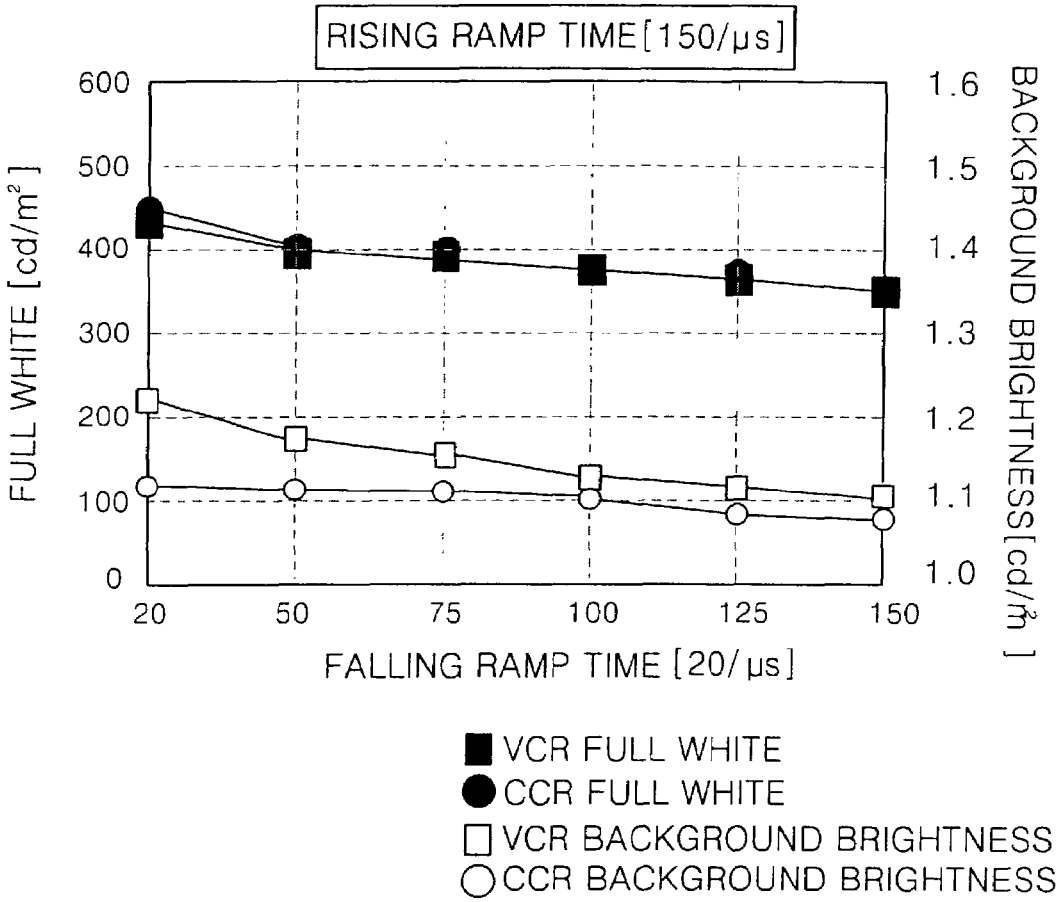

In FIG. 13C and FIG. 13D, when an application time of a rising initialization waveform is 100 μs or 150 μs, a background light brightness of the CCR according to the present invention appears lower than that of the conventional VCR with respect to all the application times (i.e., 20 μs, 50 μs, 100 μs and 150 μs) of a falling initialization waveform. On the other hand, a full-white brightness in the sustain period of the present CCR appears slightly higher than that of the conventional VCR with respect to all the application times.

It can be seen from FIG. 13A to FIG. 13D that, as application times of the rising and falling initialization waveforms in both the CCR and the VCR go shorter, their background light brightness caused by a strong discharge are increased, and that the CCR has an entirely lower background light brightness than the VCR. Particularly, when an application time of a rising initialization waveform is 20 μs, the conventional VCR has higher background light brightness than the CCR according to the present invention because it suddenly applies a discharge current after an initializing discharge to thereby oscillate a gap voltage between an applied voltage and a wall voltage within the discharge cell. On the other hand, the CCR according to the present invention has lower background light brightness than the conventional VCR because it limits a sudden application of a discharge current even after an initializing discharge.

Also, it can be seen that a brightness of a rising initialization waveform applied during time intervals from 50 μs until 150 μs in the CCR is almost equal to that in the VCR. On the other hand, when each application time of the rising and falling initialization waveforms in the VCR is 20 μs, a background light brightness is suddenly increased due to a misfiring and a brightness in the sustain period is reduced. Accordingly, since a contrast ratio becomes lower as a background light brightness goes higher, a background light of the CCR according to the present invention has a lower brightness than the conventional VCR to thereby improve its contrast ratio.

Figure 14:
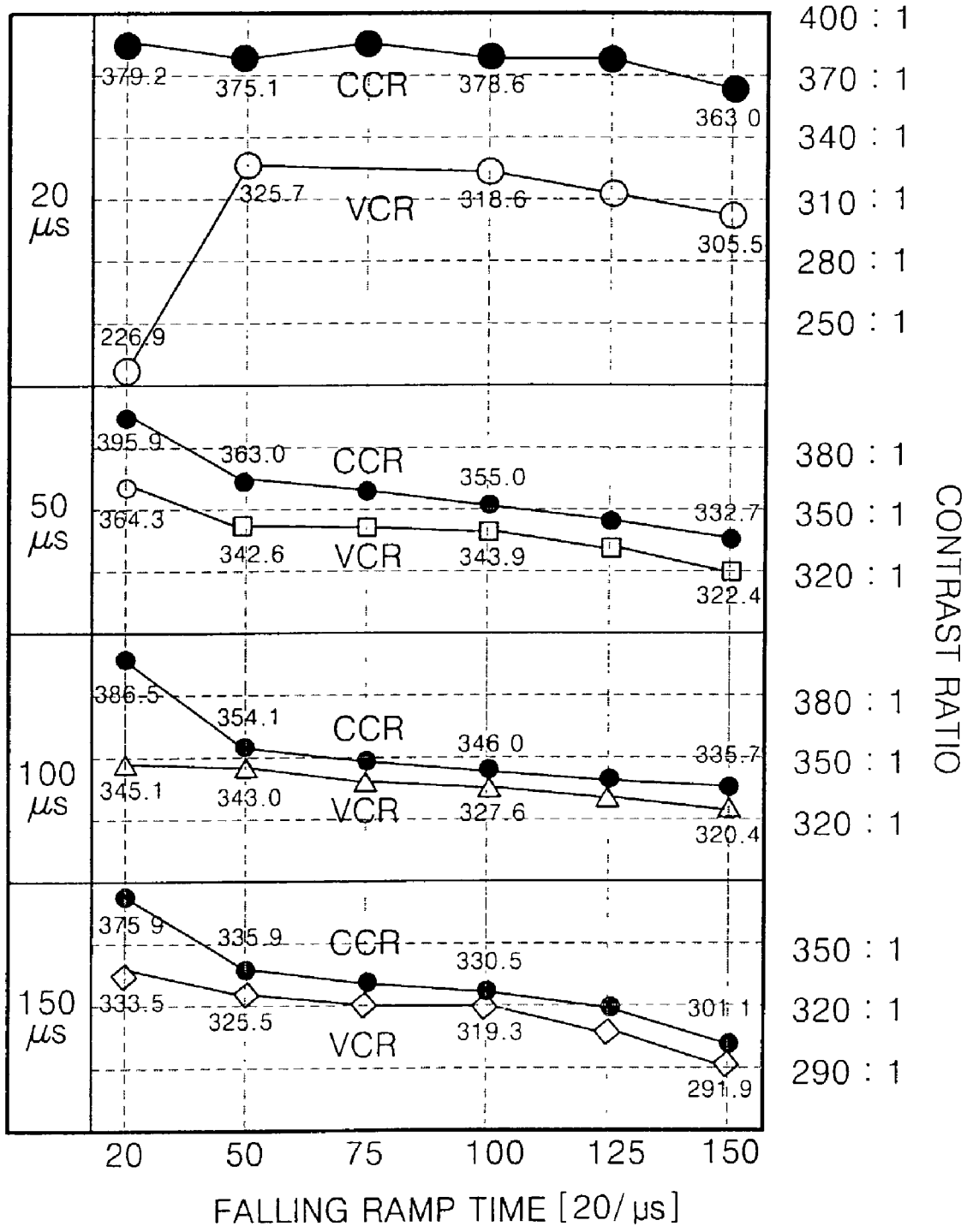
FIG. 14 is a graph for comparing a contrast ratio according to a ramp waveform supply time of the conventional VCR with that of the present CCR.

FIG. 14 shows contrast ratios according to application times of rising and falling initialization waveforms. Herein, the horizontal axis represents application times of a falling initialization waveform, the left vertical axis does application times of a rising initialization waveform, and the right vertical axis does contrast ratios.

It can be seen from FIG. 14 that, when application times of rising and falling initialization waveforms are 20 μs, 50 μs, 100 μs and 150 μs, a contrast ratio for the conventional VCR system is much lower than that for the present CCR system. Particularly, if each application time of the rising or falling initialization waveform is reduced to 20 μs so as to shorten an initialization interval, then a contrast ratio at an area where a misfiring has not been generated for the present CCR system is about 20% higher than that for the conventional VCR. It can be seen that, since the VCR system generates a misfiring when each application time of the rising and falling initialization waveforms is reduced to 20 μs, a contrast ratio of the CCR according to the present invention becomes very high.

Figure 15A:
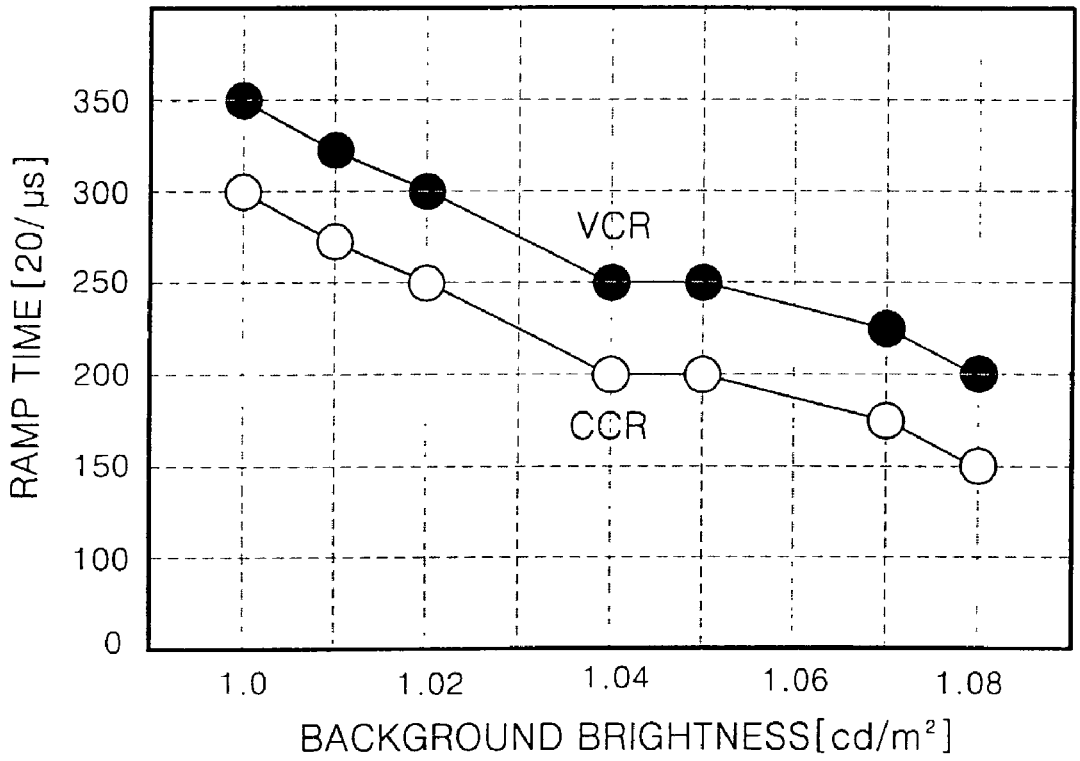
FIG. 15A is a graph for comparing a ramp waveform supply time of the VCR with that of the CCR at the same background light brightness.

FIG. 15A compares an application time of an initialization waveform in the VCR with that in the CCR at the same background light brightness. Herein, the horizontal axis represents a background light, and the vertical axis does an application time of an initialization waveform.

It can be seen from FIG. 15A that an application time of an initialization waveform in the present CCR is shorter than that in the conventional VCR at the same background light brightness.

Figure 15B:
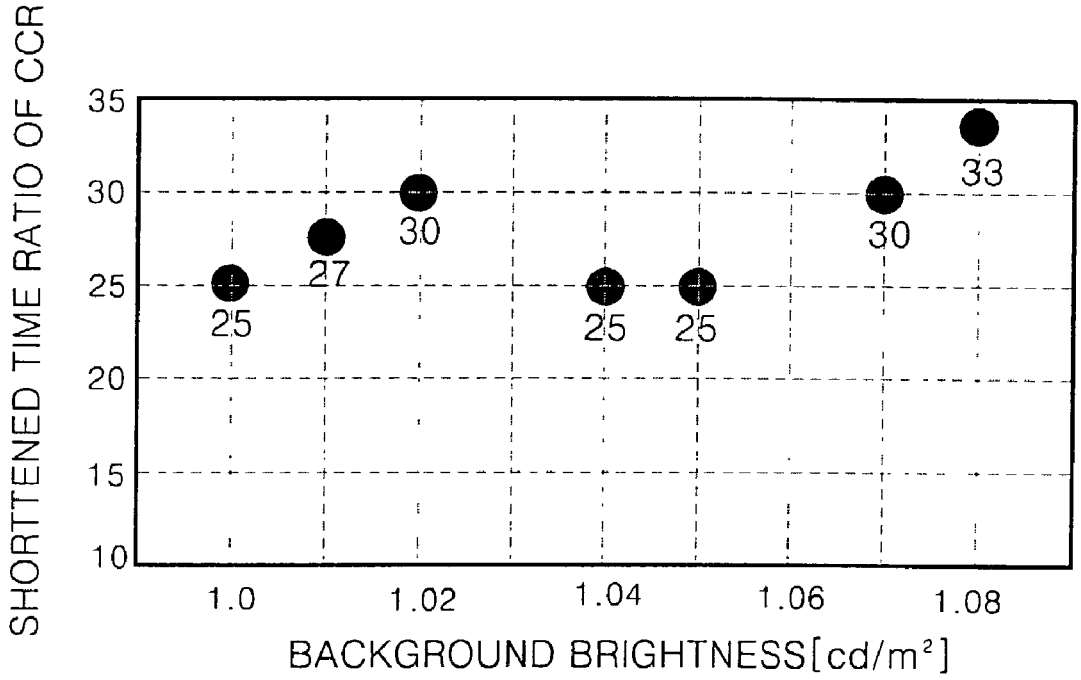
FIG. 15B is a graph representing shortened ratios of the VCR and the CCR to a supply time of the initialization waveform at the same background light brightness in FIG. 15A.

Referring to FIG. 15B, the CCR can reduce an application time of an initialization waveform corresponding to about 50 μs to 75 μs in comparison to the VCR at a position where the VCR has the same brightness value as the CCR. More specifically, when a background light brightness is 1.08 cd/m$^2$, an application time of an initialization waveform in the VCR is 150 μs while an application time of an initialization waveform in the CCR is 100 μs. Thus, the CCR according to the present invention can reduce an application time of an initialization waveform by about 50 μs in comparison to the conventional VCR. Further, when a background light brightness is 1.0 cd/m$^2$, an application time of an initialization waveform in the VCR is 300 μs while an application time of an initialization waveform in the CCR is 225 μs. Thus, the CCR according to the present invention can reduce an application time of an initialization waveform by about 75 μs in comparison to the conventional VCR. If an application time of an initialization waveform in the CCR is compared with that in the VCR at the same background light brightness value, then the CCR can shorten an application time of an initialization waveform by about 25% to 33% in comparison to the VCR. Accordingly, an initialization time can be reduced to enlarge a sustain period, thereby providing a brightness improvement.

As described above, according to the present invention, a rising or falling initialization waveform is controlled after an electrical signal of an initialization waveform applied to the discharge cell was detected, so that a dark room brightness can be reduced at an initialization period to thereby improve a contrast ratio and shorten an initialization time. Accordingly, a write period is increased to permit a single scanning. Particularly, a sustain period can increased to improve a brightness.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel, comprising:

a first sensing device for sensing a first electrical signal having a first initialization waveform, the first electrical signal being provided using a voltage source to be applied to a display panel during an initialization period;

a controlling device for controlling said first electrical signal having the first initialization waveform provided from the voltage source to be applied to the display panel, the controlling device controlling the first electrical signal during the initialization period based on the sensed first electrical signal; and a second sensing device for sensing a second electrical signal having a second initialization waveform during the initialization period and for controlling the second electrical signal during the initialization period based on the sensed second electrical signal, the second electrical signal to be applied to the display panel during the initialization period.

2. The driving apparatus as claimed in claim 1, wherein the controlling device is a switching device arranged between the voltage source and the display panel.

3. The driving apparatus as claimed in claim 2, wherein the controlling device further includes:

a control signal generating device provided between a control terminal of the switching device and the display panel to control the switching device.

4. The driving apparatus as claimed in claim 1, wherein the voltage source is one of a setup voltage source and a set-down voltage source.

5. The driving apparatus as claimed in claim 1, wherein the first sensing device or the second sensing device is a resistor device provided between the controlling device and the display panel.

6. The driving apparatus as claimed in claim 5, wherein the resistor device adjusts a rising slope of said first initialization waveform applied to the display panel during the initialization period.

7. The driving apparatus as claimed in claim 5, wherein the resistor device adjusts a falling slope of said second initialization waveform applied to the display panel during the initialization period.

8. The driving apparatus as claimed in claim 1, wherein said first electrical signal or said second electrical signal is one of a current and a voltage.

9. The driving apparatus as claimed in claim 1, wherein the controlling device controls the first electrical signal based on the sensed first electrical signal during the initialization period and until the first initialization waveform reaches a setup voltage.

10. The driving apparatus as claimed in claim 9, wherein the voltage source comprises a setup voltage source.

11. The driving apparatus as claimed in claim 1, wherein the controlling device controls the first electrical signal based on the sensed first electrical signal during the initialization period and until the first initialization waveform reaches a set-down voltage.

12. The driving apparatus as claimed in claim 11, wherein the voltage source comprises a set-down voltage source.

13. The driving apparatus as claimed in claim 1, wherein the controlling device controls a slope of the first initialization waveform during the initialization period.

14. The driving apparatus as claimed in claim 1, further comprising another voltage source, and the second electrical signal being provided using the another voltage source.

15. A driving apparatus for a plasma display panel, comprising:

a setup voltage source;

a set-down voltage source;

a first sensing device for sensing an electrical signal having a first initialization waveform, the electrical signal being provided during an initialization period using the setup voltage source to be applied to a display panel;

a first controlling device for controlling said electrical signal having said first initialization waveform provided using the setup voltage source to be applied to the display panel during the initialization period based on the sensed electrical signal;

a second sensing device for sensing an electrical signal having a second initialization waveform, the electrical signal being provided during the initialization period using the set-down voltage source to be applied to a display panel; and a second controlling device for controlling said electrical signal having said second initialization waveform provided from the set-down voltage source to be applied to the display panel during the initialization period based on the sensed electrical signal.

16. The driving apparatus as claimed in claim 15, wherein the second sensing device is a second resistor device provided between the second controlling device and the set-down voltage source.

17. The driving apparatus as claimed in claim 16, wherein the second resistor device adjusts a falling slope of said second initialization waveform applied to the display panel during the initialization period.

18. The driving apparatus as claimed in claim 15, wherein the second controlling device is a second switching device arranged between the set-down voltage source and the display panel.

19. The driving apparatus as claimed in claim 15, wherein the first controlling device is a first switching device arranged between the setup voltage source and the display panel.

20. The driving apparatus as claimed in claim 19, wherein the first controlling device includes:

a first control signal generating device provided between a control terminal of the first switching device and the display panel.

21. The driving apparatus as claimed in claim 20, wherein the second controlling device includes:

a second control signal generating device provided between a control terminal of the second switching device and the display panel.

22. The driving apparatus as claimed in claim 15, wherein said electrical signal is one of a current and a voltage.

23. The driving apparatus as claimed in claim 15, wherein the first controlling device controls the electrical signal having the first initialization waveform during the initialization period.

24. The driving apparatus as claimed in claim 15, wherein the second controlling device controls the electrical signal having the second initialization waveform during the initialization period.

25. The driving apparatus as claimed in claim 15, wherein the first controlling device controls the electrical signal during the initialization period based on the sensed electrical signal from the first sensing device and until the first initialization waveform reaches a setup voltage of the setup voltage source.

26. The driving apparatus as claimed in claim 15, wherein the second controlling device controls the electrical signal during the initialization period based on the sensed electrical signal from the second sensing device and until the second initialization waveform reaches a set-down voltage of the set-down voltage source.

27. The driving apparatus as claimed in claim 15, wherein the first controlling device controls a slope of the first initialization waveform during the initialization period.

28. The driving apparatus as claimed in claim 15, wherein the first sensing device is a first resistor device provided between the first controlling device and the display panel.

29. The driving apparatus as claimed in claim 28, wherein the first resistor device adjusts a rising slope of said first initialization waveform applied to the display panel during the initialization period.

30. A method of driving a plasma display panel, comprising the steps of:

sensing a first electrical signal having a first initialization waveform in which the first electrical signal is provided using a voltage source to be applied to a display panel during an initialization period;

controlling said first electrical signal having the first initialization waveform provided using the voltage source to be applied the display panel, the controlling occurring during the initialization period based on the sensed first electrical signal; and sensing a second electrical signal having a second initialization waveform during the initialization period and controlling the second electrical signal during the initialization period based on the sensed second electrical signal, the second electrical signal to be applied to the display panel during the initialization period.

31. The method as claimed in claim 30, wherein controlling said first electrical signal having said first initialization waveform includes adjusting one of rising and falling slopes of said first initialization waveform provided to the display panel during the initialization period.

32. The method as claimed in claim 30, wherein controlling the first electrical signal comprises controlling the first electrical signal during the initialization period based on the sensed first electrical signal and until the initialized waveform reaches a setup voltage.

33. The method as claimed in claim 32, wherein the voltage source comprises a setup voltage source.

34. The method as claimed in claim 30, wherein controlling the first electrical signal comprises controlling the first electrical signal during the initialization period based on the sensed first electrical signal and until the first initialization waveform reaches a set-down voltage.

35. The method as claimed in claim 34, wherein the voltage source comprises a set-down voltage source.

36. The method as claimed in claim 30, wherein controlling the first electrical signal includes controlling a slope of the first initialization waveform during the initialization period.

37. The method as claimed in claim 30, further comprising providing the second electrical signal using another voltage source.

38. The method as claimed in claim 30, wherein the voltage source is one of a setup voltage source and a set-down voltage source.

39. The method as claimed in claim 30, wherein said first electrical signal or said second electrical signal is one of a current and a voltage.

40. A method of driving a plasma display panel, comprising the steps of:

sensing an electrical signal having a first initialization waveform provided using a setup voltage source to be applied to a display panel during an initialization period;

controlling said electrical signal having said first initialization waveform provided using the setup voltage source to be applied to the display panel during the initialization period based on the sensed electrical signal;

sensing an electrical signal having a second initialization waveform provided using a set-down voltage source to be applied to the display panel during the initialization period; and controlling said electrical signal having said second initialization waveform provided using the set-down voltage source to be applied to the display panel during the initialization period based on the sensed electrical signal.

41. The method as claimed in claim 40, wherein controlling said electrical signal having said second initialization waveform includes adjusting a falling slope of said second initialization waveform applied to the display panel during the initialization period.

42. The method as claimed in claim 40, wherein controlling the electrical signal having the first initialization waveform includes controlling the electrical signal having the first initialization waveform during the initialization period.

43. The method as claimed in claim 40, wherein controlling the electrical signal having the second initialization waveform includes controlling the electrical signal having the second initialization during the initialization period.

44. The method as claimed in claim 40, wherein controlling the electrical signal having the first initialization waveform is based on the sensed electrical signal and occurs until the first initialization waveform reaches a setup voltage of the setup voltage source.

45. The method as claimed in claim 40, wherein controlling the electrical signal having the second initialization waveform is based on the sensed electrical signal and occurs until the second initialization waveform reaches a set-down voltage of the set-down voltage source.

46. The method as claimed in claim 40, wherein controlling the electrical signal having the first initialization waveform comprises controlling a slope of the first initialization waveform during the initialization period.

47. The method as claimed in claim 40, wherein said electrical signals having said first and second initialization waveforms are one of a current and a voltage.

48. The method as claimed in claim 40, wherein controlling said electrical signal having said first initialization waveform includes adjusting a rising slope of said first initialization waveform applied to the display panel during the initialization period.

* * * * *